United States Patent [19]

Komuro

[11] Patent Number: 4,968,992

[45] Date of Patent: Nov. 6, 1990

[54] METHOD FOR MANUFACTURING A LIQUID JET RECORDING HEAD HAVING A PROTECTIVE LAYER FORMED BY ETCHING

[75] Inventor: Hirokazu Komuro, Hiratsuka, Japan

[73] Assignee: Canon Kabushiki Kaisha, Tokyo, Japan

[21] Appl. No.: 382,038

[22] Filed: Jul. 18, 1989

Related U.S. Application Data

[63] Continuation of Ser. No. 296,326, Jan. 11, 1989, abandoned, which is a continuation of Ser. No. 20,766, Mar. 2, 1987, abandoned.

[30] Foreign Application Priority Data

Mar. 4, 1986 [JP] Japan ..... 61-45283

[51] Int. Cl.[5] ..... B41J 2/05

[52] U.S. Cl. ..... 346/1.1; 346/140 R

[58] Field of Search ..... 346/1.1, 140

[56] References Cited

U.S. PATENT DOCUMENTS

| | | | |
|---|---|---|---|
| 4,336,548 | 6/1982 | Matsumoto | 346/140 |
| 4,339,762 | 7/1982 | Shirato | 346/140 |
| 4,361,842 | 11/1982 | Haruta et al. | 346/1.1 |
| 4,417,251 | 11/1983 | Sugitani | 346/1.1 |
| 4,429,321 | 1/1984 | Matsumoto | 346/140 R |
| 4,450,457 | 5/1984 | Miyachi et al. | 346/140 R |
| 4,567,493 | 1/1986 | Ikeda et al. | 346/140 R |
| 4,577,202 | 3/1986 | Hara | 346/140 R |
| 4,686,544 | 8/1987 | Ikeda | 346/140 |
| 4,720,716 | 1/1988 | Ikeda et al. | 346/140 R |
| 4,725,859 | 2/1988 | Shibata et al. | 346/140 R |

*Primary Examiner*—Joseph W. Hartary

*Attorney, Agent, or Firm*—Fitzpatrick, Cella, Harper & Scinto

[57] ABSTRACT

A method of manufacturing a substrate for a liquid jet recording head comprises forming an upper layer with a bulging portion on a thermal energy generating member on a support, and etching the upper layer to remove the bulging portion and form a protective layer on the support and energy generating member. An ink jet recording head is formed by connecting the support and a grooved member.

19 Claims, 6 Drawing Sheets

METHOD FOR MANUFACTURING A LIQUID JET RECORDING HEAD HAVING A PROTECTIVE LAYER FORMED BY ETCHING

This application is a continuation of application Ser. No. 296,326, filed Jan. 11, 1989, now abandoned, which is a continuation of application Ser. No. 020,766, filed Mar. 2, 1987, now abandoned.

BACKGROUND OF THE INVENTION

1. Field of the Invention

The present invention relates to a method for manufacturing a liquid jet recording head, and more particularly, to a method for manufacturing a liquid jet recording head having thermal energy generation means.

2. Related Background Art

Of the known recording methods, a liquid jet recording method (ink jet recording method) is a non-impact recording method which does not generate noise when recording characters, enables high speed recording, and can record characters on plain paper without a special fixing process. It is thus a very effective recording method. Various proposals have been made to the liquid jet recording method some of which have been commercialized and some of which are still under study.

In the liquid jet recording method, droplets of the recording liquid (ink) are flown by one of several actions and are deposited to a record sheet such as a paper to record characters. A novel liquid jet recording method is proposed in, for example, German Patent application No. DE284306401A1. A basic principle thereof is as follows. A thermal pulse is applied as an information signal to recording liquid in an action chamber, so that the recording liquid generates vapor bubbles which collapse. By a force created during the above process, the recording liquid is discharged from a liquid discharge port connected to the action chamber so that it is flown as droplets, which are deposited onto the record sheet to record the characters.

In this method, by using a high density multi-array structure, high speed recording and color recording are easily attained, and the construction of the apparatus is simpler than a conventional one. Accordingly, a recording head is both compact and suitable for mass production. By fully utilizing advantages of IC technology and micro-machining technology which have been well developed in a semiconductor field, a long web can be easily manufactured.

A typical recording head of a liquid jet recorder used in the above liquid jet recording method is provided with thermal energy generation means for discharging recording liquid from a liquid discharge port to form flying droplets.

The thermal energy generation means is preferably arranged to directly contact to the recording liquid so that generated thermal energy is effectively impacted to the recording liquid and an ON-OFF response speed of the thermal action to the recording liquid is increased.

However, the thermal energy generation means basically comprises a heat generating resistive layer which generates heat when energized and a pair of electrodes for supplying power to the heat generating resistive layer. Accordingly, if the heat generating resistive layer directly contacts the recording liquid, (1) the recording liquid is electrolyzed by a current flowing through the recording liquid depending on the electrical resistance of the recording liquid, (2) the heat generating resistive layer reacts with the recording liquid when a current is supplied so that the resistance of the heat generating resistive layer changes due to erosion thereof or (3) the heat generating resistive layer is broken or damaged.

In the past, the heat generating resistive layer is made of an inorganic material such as NiCr alloy or metallic boronide such as $ZrB_2$ or $HfB_2$, which has a relatively excellent property as the heat generating resistive material, and a protection layer made of high anti-oxidization material such as $SiO_2$ is formed on the heat generating resistive layer to prevent the heat generating resistive layer from directly contacting the recording liquid, in order to resolve the above problems and improve the reliability and durability for repetitive use.

In forming the thermal energy generation means, it is common to form the heat generating resistive layer on a support and then stack the electrodes and protection layer thereon. The protection layer of the thermal energy generation means must uniformly cover the heat generating resistive layer and the electrodes without defects such as pinholes so that it fully functions to prevent the breakage of the heat generating layer and short circuits between the electrodes.

In the liquid jet recording head, the electrodes are usually formed on the heat generating resistive layer and hence there is a step between the electrode and the heat generating resistive layer. Since the layer thickness is ununiform at the step, the layer must be formed to completely cover the step so that there is no exposed area. If the step coverage is not complete, the exposed area of the heat generating resistive layer directly contacts to the recording liquid so that the recording liquid is electrolyzed or the recording liquid reacts to break the heat generating resistive layer. Also, the film is not homogeneous at the step. Such unhomogeneity results in concentration of thermal stress in the protection layer through repetitive heat generation and causes cracks in the protection layer. The recording liquid penetrates through such cracks to break the heat generating resistive layer. Further, the recording liquid may penetrate through a pinhole to break the heat generating resistive layer.

In the past, in order to resolve the above problems, the thickness of the protection layer is increased to improve the step coverage and reduce the pinholes. However, the thick protection layer contributes to the improvement of the step coverage and the reduction of the pinholes but impedes the supply of heat to the recording liquid, which raises the following additional problem.

The heat generated in the heat generating resistive layer is conveyed to the recording layer through the protection layer. When the protection layer is thick, the thermal resistance between the protection layer which is an action plane of the heat and the heat generating resistive layer increases and hence more power must be supplied to the heat generating resistive layer, and so (1) It is disadvantageous for power saving.

(2) Unnecessary heat is stored in the support and thermal response is lowered.

(3) Durability of the heat generating resistive layer is lowered because of larger power.

Those problems may be resolved by reducing the thickness of the protection layer. However, in the conventional method for manufacturing the liquid jet recording head in which a film forming method such as sputtering or vapor deposition is used to form the protection layer, there is a problem of durability because of insufficient step coverage and it is difficult to reduce the thickness of the protection layer.

In the recording by the liquid jet recording head, it has been known that forming stability of the recording liquid is improved as the recording liquid is heated more rapidly. Namely, the shorter a pulse width of an electrical signal (rectangular pulse) that is applied to the thermal energy generation means, the better the forming stability of the recording liquid, and the discharge stability of the flying droplet and a record quality is improved. However, in the conventional liquid jet recording head, the protection layer must be thick and hence the thermal resistance of the protection layer is high. As a result, a larger thermal energy must be generated by the thermal energy generation means and the durability and the thermal response are degraded. As a result, it is difficult to reduce the pulse width and improvement of the record quality is limited.

SUMMARY OF THE INVENTION

It is an object of the present invention to provide a novel method for manufacturing a liquid jet recording head which attains power saving, high durability and response and improves record quality.

The above-mentioned object can be achieved, according to the present invention, by a process for producing a liquid emission recording head provided with an orifice for emitting recording liquid, thermal energy generation means for supplying said recording liquid with an emission energy, and a protective layer for said means provided thereon, wherein said thermal energy generation means is composed of a heat generating resistor layer and at least a pair of electrodes connected electrically to said heat generating resistor layer, which comprises the formation of said protective layer by laminating an upper layer consitituting said protective layer on said thermal energy generation means, followed by etching said upper layer.

BRIEF DESCRIPTION OF THE DRAWINGS

FIGS. 5 to 8 illustrate steps for manufacturing the liquid jet recording head of the embodiment, in which FIGS. 5 and 6 show substrates prior to the formation of a protection layer, and FIGS. 7 and 8 show the substrate after the formation of the protection layer.

DETAILED DESCRIPTION OF THE PREFERRED EMBODIMENTS

Figure 1:
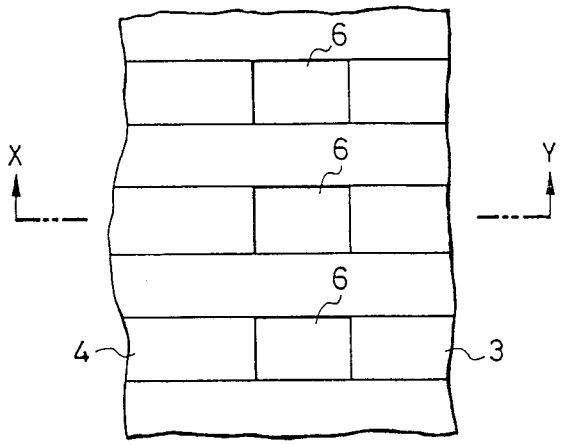
FIG. 1 shows a partial plan view of one embodiment of a liquid jet recording head manufactured by the present method.
Figure 2:
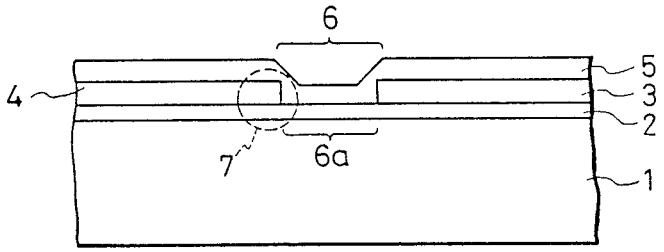
FIG. 2 shows an X-Y sectional view of FIG. 1.

FIGS. 1 and 2 show an embodiment of the liquid jet recording head manufactured by the present method. FIG. 1 shows a partial plan view of a vicinity of thermal energy generation means of the head, and FIG. 2 shows an X-Y sectional view of FIG. 1.

As shown in FIGS. 1 and 2, the liquid jet recording head is manufactured by forming at least one set of thermal energy generation means comprising a heat generating resistive layer 2 and at least one pair of electrode 3 and 4 electrically connected to the layer 2, on a support member 1 of any shape made of glass, ceramics or plastic material, forming an upper layer which is to act as a protection layer 5, on the thermal energy generation means, and etching the upper layer to form the protection layer 5. Numeral 6 denotes a thermal action plane which conveys a heat generated by supplying a power to a heat generation area 6a of the heat generating resistive layer 12 formed between the electrodes 3 and 4, to the recording liquid, and numeral 7 denotes a step formed between the heat generating resistive layer 2 and the electrodes 3 and 4.

Figure 10:
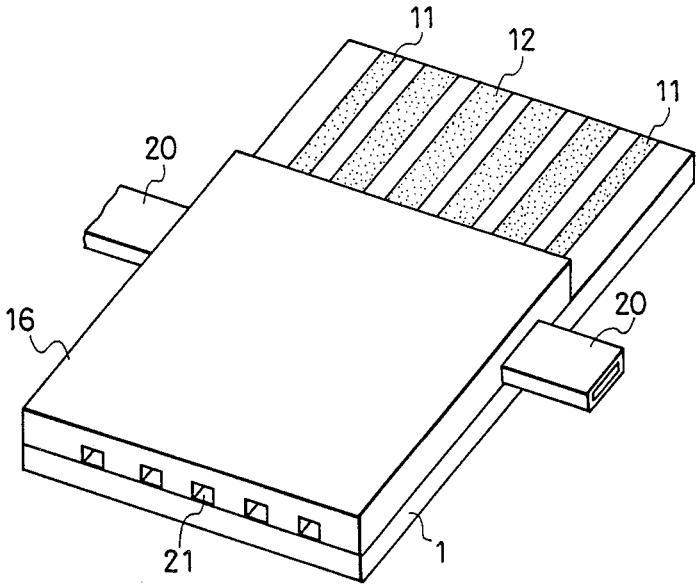
FIG. 10 shows a perspective view of a completed liquid jet recording head shown in FIGS. 1 and 2.

FIG. 10 shows a sectional view of a completed liquid jet recording head shown in FIGS. 1 and 2 manufactured in accordance with the present method. Numeral 21 denotes a liquid discharge port through which the recording liquid is discharged.

Figure 9:
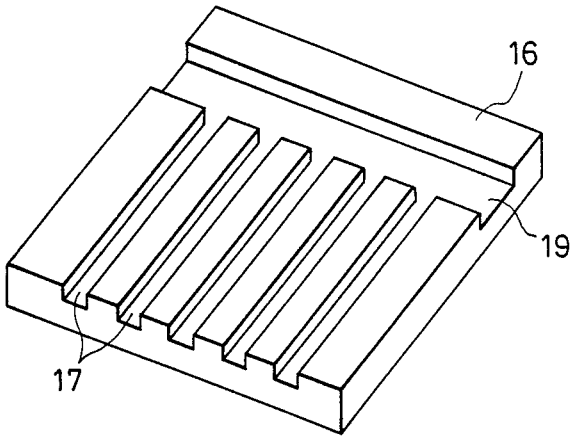
FIG. 9 shows a top plate used for a liquid jet recording head of FIG. 10.

The liquid jet recording head is manufactured, by forming the thermal energy generation means having the protection layer 5, on the support member 1, and joining to the support member 1 a grooved top plate 16 shown in FIG. 9 which defines action chambers one for each of the thermal energy generation means and grooves to form liquid discharge ports 21 connecting to the action chambers. In FIG. 9, numeral 17 denotes the groove which forms the liquid flow path or action chamber, and numeral 19 denotes a common liquid chamber for supplying the recording liquid to the liquid flow paths 17. A liquid supply tube 20 shown in FIG. 10 is connected to the common liquid chamber 19, and the recording liquid is supplied to the head through the liquid supply tube 20. In joining the top plate 16, it is preferable that it is carefully positioned so that the thermal energy generation means face the liquid flow paths 17.

Figure 3:
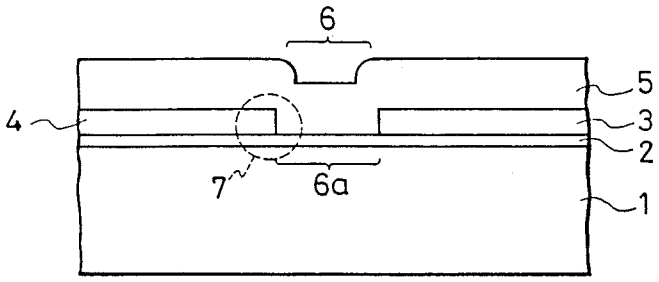
FIG. 3 PRIOR ART
FIG. 3 shows a prior art liquid jet recording head.

In the manufacture of a conventional liquid jet recording head shown in FIG. 3, a layer defect such as pinhole is apt to be created in the protection layer 5, and an exposed area is apt to be created at a step 7. Accordingly, the protection layer must be thicker than necessary (normally, two times as thick as the electrode thickness). In the present invention, the protection layer 5 is formed by forming the upper layer which is to act as the protection layer 5, and etching the upper layer, and repeating the stacking and etching of the upper layer and the photo-resist layer as required. Accordingly, layer defects such as unhomogeneity of the film which will cause pinholes or cracks can be eliminated. Since the stacking and etching of the upper layer is repeated as required, any protection layer thickness is attained, and the problem associated with the thickening of the protection layer 5 to eliminate the layer defect and improve the step coverage is resolved, power is saved and the durability and the thermal response of the liquid jet recording head are improved. In the present invention, the thickness of the protection layer may be less than 1.5 times of the electrode thickness.

In the present invention, the heat generating resistive layer, electrodes and upper layer may be made of known materials and formed by known film formation methods such as RF sputtering, chemical vapor deposition (CVD) and vacuum vapor deposition.

The etching of the upper layer may be done by any known etching technique such as wet etching with etchant, or dry etching such as sputter etching or reactive ion etching (RIE). Dry etching is preferable in view of simplicity of the process, and sputter etching is most preferable. (The dependency of angle in the etching rate can be utilized.)

An embodiment of the method for manufacturing a substrate for the liquid jet recording head of the present invention is explained with reference to FIGS. 4A to 4D.

Figure 4A:
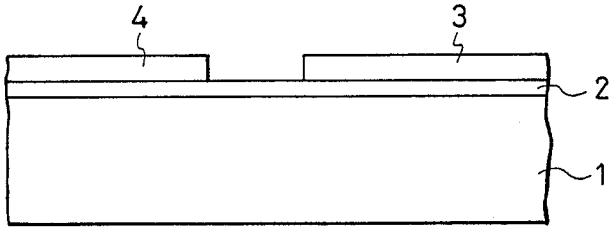
FIGS. 4A–4D illustrate the present method.

As shown in FIG. 4A, the heat generating resistive layer 2 is formed on the support member 1 by vacuum vapor deposition or sputtering. While not shown in the present embodiment for the purpose of simplicity of explanation, a functional layer such as a heat storage layer 9 shown in FIGS. 5 and 6 may be formed on the substrate 1.

An electrode layer is uniformly formed on the resistive layer 2 by vacuum vapor deposition or sputtering in order to form the electrodes 3 and 4. The electrode layer and the heat generating resistive layers 2 are patterned by a known photolithography technique to form, on the support member 1, the thermal energy generation means comprising the patterned heat generating resistive layer 2 and electrodes 3 and 4.

Figure 4B:
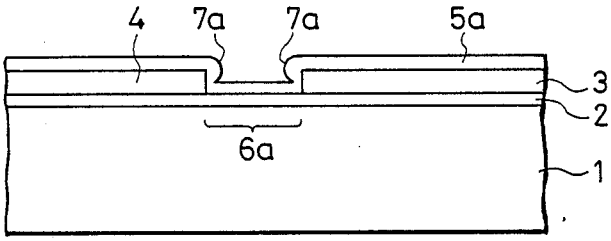

As shown in FIG. 4B, the upper layer 5*a* made of $Si_3N_4$, $SiO_2$, SiON or $Ta_2O_5$ is formed to a thickness approximately two times as large as the thickness of the electrodes 3 and 4, by the vacuum vapor deposition, sputtering or CVD in order to form the protection layer on the thermal energy generation means.

Figure 4C:
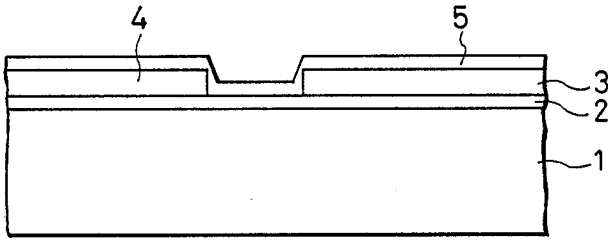

The upper layer 5*a* is also etched by sputter etching etc. to form the protection layer 5 of a desired thickness as shown in FIG. 4C.

The etching conditions such as etching gas and etching speed can be suitably selected according for the material of the protective layer, but argon gas or the like can be conveniently employed in case of sputter etching. Although not particularly explained in the foregoing, bulging portions 7*a* tend to appear in the step portion 7 as shown in FIG. 4B, at the formation of the protective layer 5. Such bulging portion 7*a* should preferably be removed as it not only induces defects but also hinders heat transfer to the recording liquid, but effective removal of such bulging portion 7*a* cannot be achieved using conventional technology. However, according to the present invention, the bulging portion 7*a* can be removed by the etching conducted after the lamination of the upper layer 5*a*, so that a uniform and satisfactory protective layer 5 as shown in FIG. 4C can be obtained without increasing the thickness.

Figure 4D:
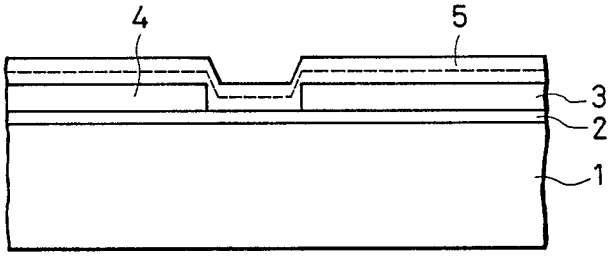

Such formation and etching of the upper layer 5*a* are conducted only once, but it is also possible to form the protective layer 5 by repeating the formation of the upper layer 5*a* and the etching thereof as shown in FIG. 4D, for example for improving the performance of the protective layer 5. In case of such repeated process, the etching need not, naturally, be applied to all the upper layers 5*a* thus repeatedly formed, but needs at least be applied to the lowermost upper layer 5*a*. Also the protective layer 5 need not be composed of a single material but can be composed of plural layers of two or more materials for improving the anti-cavitation properties (resistance against erosion caused by bubbles generated by the thermal energy generating means).

On the support member 1, having the thermal energy generating means provided with the protective layer 5 formed as explained above, the cover plate 16 with grooves as shown in FIG. 9 is adhered with sufficient alignment, and a liquid supply pipe 20 for introducing the recording liquid from an unillustrated supply system to the interior of the recording head, thereby completing a liquid jet recording head as shown in FIG. 10.

Though not particularly explained in the foregoing, the orifices and the liquid flow paths need not necessarily be formed by a grooved plate as shown in FIG. 9 but may be formed by grooved pattern provided by a photosensitive resin. Also the present invention is applicable not only to the liquid jet recording head of multiple array type with plural orifices as explained in the foregoing but also to the head of single array type provided with only one orifice.

As explained in the foregoing, the present invention can provide a liquid jet recording head provided with a protective layer without defects and with satisfactory step coverage, since the protective layer is formed by the formation of an upper layer and etching thereof, which are repeated if necessary, and for liquid jetting, recording head can achieve not only electric power economization but also satisfactory durability, high thermal response and satisfactory recording quality.

In the following there is described an example of the present invention.

EXAMPLE

A liquid jet recording head as shown in FIG. 10 was prepared in the following manner.

Figure 5:
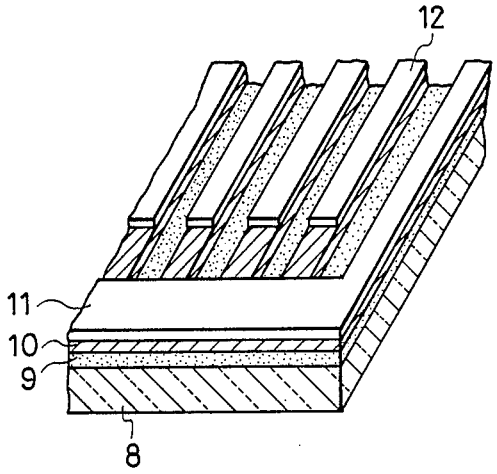
Figure 6:
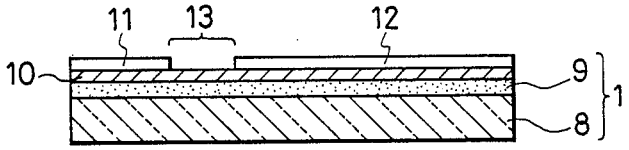

At first a support member 1, provided with a thermally oxidized heat accumulation layer 9 as an underlying layer of $SiO_2$ of a thickness of 5 μm on a Si plate 8 as shown in FIGS. 5 and 6, was prepared. On said support member 1 there was formed a heat generating resistor layer 10 of a thickness of 1300 Å, composed of $HfB_2$, by sputtering.

On the heat generating resistor layer 10, an aluminum layer to constitute the electrodes 11, 12 was formed with a thickness of 5000 Å by vacuum evaporation. Subsequently said aluminum layer and heat generating resistor layer 10 were subjected to patterning by a photolithographic process to form, on the support member, the thermal energy generating means having a heat generating portion 13 of width 30 μm×length 150 μm, and a circuit pattern of a resistance of 100 Ω including the electrodes 11, 12. In the present example the input electrodes 12 are formed as individual electrodes for enabling selective heating of each of the thermal energy generating means, but the output electrodes 11 are formed as a common electrode for simplifying the electrode structure.

Figure 7:
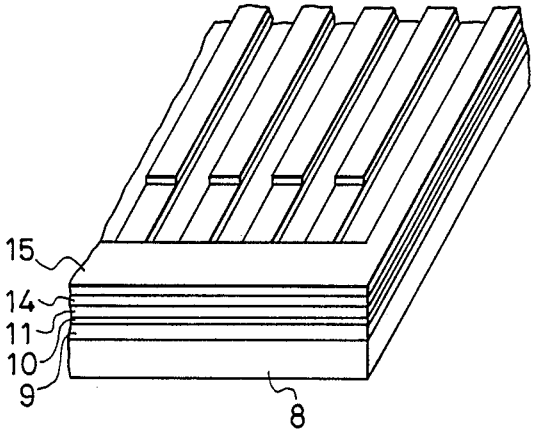
Figure 8:
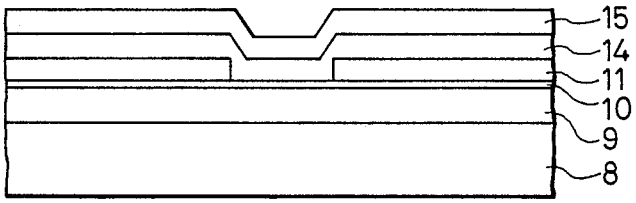

Then, as shown in FIGS. 7 and 8, an upper layer 14 composed of $SiO_2$ was formed with a thickness of ca. 5000 Å on the thermal energy generation means, by means of an RF sputtering apparatus. The forming conditions were RF power: 1 kW, and pressure: $1\times10^{-3}$ Torr.

After the formation of the upper layer 14*a*, said layer 14*a* was subjected to sputter etching for ca. 30 minutes at an etching rate of 50 Å/min. to reduce the thickness of said layer 14 to 3500 Å. Subsequently $SiO_2$ was laminated with a thickness of 3000 Å in the same manner as explained above on thus etched upper layer 14, and was similarly etched to obtain a first protective layer 14 composed of $SiO_2$ of a thickness of ca. 5000 Å.

Then, for improving the anti-cavitation resistance of the first protective layer 14, a second protective layer 15, composed of Ta, was formed with a thickness of ca. 5000 Å on said layer 14*a* with a similar RF sputtering apparatus, thereby obtaining a substrate provided with first and second protective layer with a total thickness of ca. 10000 Å. The protective layer thus obtained showed satisfactory step coverage and was free from defects such as pinholes.

On the substrate with the protective layer formed as explained above, a grooved cover plate 16 as shown in FIG. 9 (material: glass) was adhered with sufficient alignment, and a liquid supply pipe 20 was connected to complete a liquid emission recording head as shown in FIG. 10.

Referring to FIG. 9, the grooves constituting the liquid flow paths 17 (width 40 μm, height 40 μm) and the common liquid chamber 19 were engraved on the cover plate 16 with a microcutter. Also referring to FIG. 10, the individual electrodes 12 and the common electrode 11 were attached to an unillustrated lead board having electrode leads for supplying desired pulse signals from the outside, and the recording is conducted according to said signals.

The liquid jet recording head thus prepared showed improvements of:

(1) a reduction on power consumption by ca. 50%;

(2) an improvement of thermal response by ca. 40%; and (3) satisfactory durability in operation with shorter pulses;

in comparison with the conventional head. Also the stability of bubble generation with shorter pulse drive improves the stability of jetting the recording liquid, thus improving the recording quality.

As explained in the foregoing, the present invention achieves, in a liquid jet recording head, not only electric power economization but also an improved thermal response, an improved durability, an improved emission stability and an improvement in the recording quality.

In the above embodiment, the first protective layer may includes thin-film materials such as transition metal oxides, such as, titanium oxide, vanadium oxide, niobium oxide, molybdenum oxide, tantalum oxide, tangsten oxide, chromium oxide, zirconium oxide, hafnium oxide, lanthanum oxide, yttrium oxide, manganese oxide and the like; other metals oxides, such as aluminum oxide. calcium oxide, strontium oxide, barium oxide, silicon oxide and the like; and complex of the above metals; high dielectric nitride, such as silicon nitride, aluminum nitride, boron nitride, tantalum nitride and the like; complex of the above oxides and nitrides. Further, the second protective layer may includes, an element of the group IIIa of the periodic table such as Sc or Y, an element of the group IVa such as Ti, Tr or Hf, an element of the group Va such as V or Nb, an element of the group VIa such as Cr, Mo or W, an element of the group VIII such as Fe, Co or Ni, an alloy of the above metals such as Ti-Ni, Ta-W, Ta-Mo-Ni, Ni-Cr, Fe-Co, Ti-W, Fe-Ti, Fe-Ni, Fe-Cr, Fe-Ni-Cr, a boride of the above metals such as Ti-B, Ta-B, Hf-B or W-B, a carbide of the above metals such as Ti-C, Zr-C, V-C, Ta-C, Mo-C, or Ni-C, and a silicide of the above metals such as Mo-Si, W-Si or Ta-Si, and a nitride of the above metals such as Ti-N, Nb-N or Ta-N.

The underlying layer principally functions to control the conduction of heat generated by the heat generating portion to the support. The material and the film thickness of the underlying layer are selected such that the heat generated by the heat generating portion is better conducted to the heat applying portion when thermal energy is to be applied to liquid at the heat applying portion, and the heat remaining in the heat generating portion is more rapidly conducted to the support when conduction to the heating portion 202 is blocked. The material of the underlying layer 206 includes, in addition to $SiO_2$ described above, inorganic materials as represented by metal oxides such as zirconium oxide, tantalum oxide, magnesium oxide and aluminum oxide.

The material of the heat generating resistive layer may be any material which generates a heat when energized.

Preferable examples of such materials are tantalum nitride, nickel-chromium alloy, a silver-palladium alloy, silicon semiconductor, or metals, such as hafnium, lanthanum, zirconium, titanium, tantalum, tungsten, molybdenum, niobium, chromium, vanadium etc., and alloys and borides thereof.

Of the materials of the heat generating resistive layer, the metal borides are particularly suitable, and of those, optional performance may be provided by hafnium boride, and zirconium boride, lanthanum boride, tantalum boride, vanadium boride and iobium boride follow in the order mentioned.

The heat generating resistive layer can be formed of those materials by an electron beam vapor deposition process or a sputtering process.

The film thickness of the heat generating resistive layer is determined in accordance with an area and material thereof and a shape and a size of the heat applying portion and a power consumption so that a desired heat per hour may be generated. Usually, it is 0.001–5 μm and preferably 0.01–1 μm.

The material of the electrode may be any conventional electrode material such as Al, Ag, Au, Pt or Cu. It is formed by those materials into desired size, shape and thickness at a desired position by a vapor deposition process.

In the above embodiment, a discharge direction of a recording liquid from the discharge port of the ink jet head is the same as a supply direction of the recording liquid to the heat acting surface of the thermal energy generating means, however, a liquid jet head according to the present invention is not limited to the above embodiment.

That is to say, the discharge ports may also be arranged, for example just above the heat acting surface of the thermal energy generating means.

Figure 11:
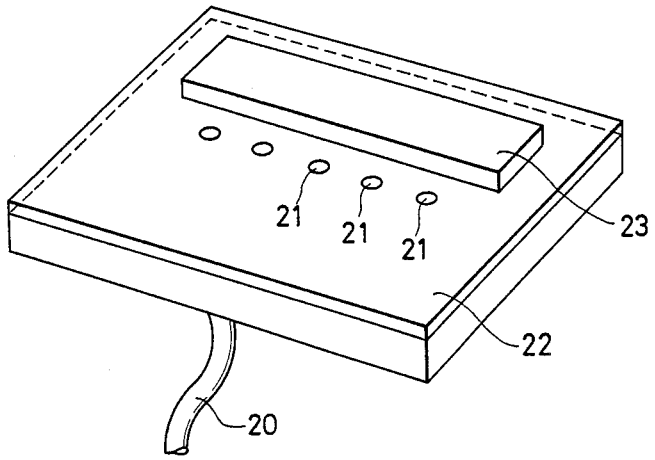
FIG. 11 is schematic perspective view of an another embodiment according to the present invention.

Such a liquid jet head is shown in FIG. 11, and FIG. 11 is schematic perspective view of an another embodiment according to the present invention.

In FIG. 11, discharge ports 21 are formed on a thermal energy generating means mounting substrate, and liquid flow and an orifice plate on which a liquid flow path is formed is adhered to the mounting substrate. Further a liquid chamber is formed and a liquid supply pipe is attached on the mounting substrate. The recording liquid is supplied to the liquid supply pipe 20 the liquid path such as the liquid chamber and the liquid flow path (not shown) and is discharged from the discharge ports 21.

In the liquid jet head shown in FIG. 11, the electric power economization, the improved thermal response, the improved durability, the improved jetting stability, and the improvement in the recording quality can also be achieved. Further, when in the above embodiment the first protective layer 14 has sufficient anti-cavitation properties, the second protective layer 15 (in FIG. 8) may be deleted.

What I claimed is:

1. A method for manufacturing a liquid jet recording head having a liquid path in communication with a discharge port for discharging liquid and comprising a support member, with thermal energy generating means on said support member for generating thermal energy to discharge the liquid, and a grooved member in which grooves are provided to form the liquid path walls, the method comprising the steps of:

providing said support member having said thermal energy generating means thereon;

forming an upper layer on said thermal energy generating means, said upper layer having a bulging portion at said thermal energy generating means;

forming a protective layer by etching said upper layer to remove said bulging portion; and connecting said support member and said grooved member with said energy generating means being positioned inside said grooves.

2. A method for manufacturing a substrate for a liquid jet recording head having a support member, with thermal energy generating means on said support member for generating thermal energy to discharge liquid, the method comprising the steps of:

providing said support member having said thermal generating means thereon;

forming an upper layer on said thermal energy generating means, said upper layer having a bulging portion at said thermal energy generating means; and forming a protective layer by etching said upper layer to remove said bulging portion.

3. A method according to claim 1 or 2, wherein said thermal energy generating means is formed on said support member by forming thereon a heat resistive layer and an electrode.

4. A method according to claim 1 or 2, wherein said protective layer forming step is performed by a dry etching method.

5. A method according to claim 2, wherein the thickness of said upper layer is about two times of that of said electrode.

6. A method according to claim 1 or 2, further comprising the step of forming a heat accumulation layer under said thermal energy generating means.

7. A method according to claim 4, further comprising the step of forming a heat accumulation layer under said thermal energy generating means.

8. A method according to claim 5, further the step of forming a heat accumulation layer under said thermal energy generating means.

9. A method according to claim 4, wherein said dry etching method is a sputter etching method.

10. A method according to claim 4, wherein said dry etching method is a reactive ion etching method.

11. A method according to claim 1 or 2, wherein said protective layer forming step is performed by a wet etching method.

12. A method according to claim 1 or 2, wherein said upper layer is made of $Si_3N_4$.

13. A method according to claim 1 or 2, wherein said upper layer is made of $SiO_2$.

14. A method according to claim 1 or 2, wherein said upper layer is made of SiON.

15. A method according to claim 1 or 2, wherein said upper layer is made of $Ta_2O_5$.

16. A method according to claim 2, wherein the thickness of said protective layer is about 1.5 times of that of said electrode.

17. A method according to claim 1 or 2, wherein said upper layer forming step and said protective layer forming step are repeatedly performed.

18. A method according to claim 1, wherein said grooved member comprises a cover plate having grooves therein.

19. A method according to claim 1, wherein said grooved member comprises a photosensitive resin having a grooved pattern therethrough.

* * * * *

UNITED STATES PATENT AND TRADEMARK OFFICE

CERTIFICATE OF CORRECTION

PATENT NO. : 4,968,992

DATED : November 6, 1990

INVENTOR(S) : HIROKAZU KOMURO

It is certified that error appears in the above-identified patent and that said Letters Patent is hereby corrected as shown below:

COLUMN 1

Line 25, "method" should read --method,--.
Line 32, "No. DE284306401A1." should read --de 28 43 064.--.
Line 57, "impacted" should read --imparted--.

COLUMN 2

Line 22, "the breakage" should read --breakage--.
Line 54, "which" should read --(which--.
Line 55, "heat and" should read --heat) and--.

COLUMN 3

Line 56, "an" should be deleted.

COLUMN 4

Line 19, "manufactured," should read --manufactured--.
Line 53, "the layer defect" should read --layer defects--.

COLUMN 6

Line 7, "grooved pattern" should read --a grooved pattern--.
Line 18, "recording head" should read --the recording head--.
Line 55, "14a, should read --14,--.
Line 56, "14a" should read --14--.
Line 66, "14a" should read --14--.

UNITED STATES PATENT AND TRADEMARK OFFICE

CERTIFICATE OF CORRECTION

PATENT NO. : 4,968,992

DATED : November 6, 1990

INVENTOR(S) : HIROKAZU KOMURO

It is certified that error appears in the above-identified patent and that said Letters Patent is hereby corrected as shown below:

COLUMN 7

Line 21, "reduction on" should read --reduction of--.
Line 36, "includes" should read --include--.
Line 38, "tang-" should read --tung- --.
Line 41, "metals" should read --metal--.
Line 47, "includes," should read --include--.

COLUMN 8

Line 1, "202" should be deleted.
Line 2, "206" should be deleted.
Line 19, "iobium" should read --niobium--.
Line 54, "20" should read --20,--.
Line 66, "claimed" should read --claim--.

COLUMN 9

Line 24, "thermal" should read --thermal energy--.

UNITED STATES PATENT AND TRADEMARK OFFICE

CERTIFICATE OF CORRECTION

PATENT NO. : 4,968,992

DATED : November 6, 1990

INVENTOR(S) : HIROKAZU KOMURO

It is certified that error appears in the above-identified patent and that said Letters Patent is hereby corrected as shown below:

COLUMN 10

Line 1, "claim 2," should read --claim 3,--.
Line 2, "times of" should read --times--.
Line 10, "further the" should read --further comprising the--.
Line 28, "claim 2," should read --claim 3,--.
Line 29, "1.5 times of" should read --1.5 times--.

Signed and Sealed this

Seventh Day of July, 1992

*Attest:*

DOUGLAS B. COMER

*Attesting Officer*

*Acting Commissioner of Patents and Trademarks*